US005701857A

United States Patent [19]

Hara

[11] Patent Number: 5,701,857

[45] Date of Patent: Dec. 30, 1997

[54] CYLINDER VALVE OPERATING SYSTEM

[75] Inventor: Seinosuke Hara, Atsugi, Japan

[73] Assignee: Unisia Jecs Corporation, Atsugi, Japan

[21] Appl. No.: 730,007

[22] Filed: Oct. 11, 1996

[30] Foreign Application Priority Data

Oct. 12, 1995 [JP] Japan ..... 7-264045

[51] Int. Cl.[6] ..... F01L 1/26; F01L 13/00; F02D 13/06

[52] U.S. Cl. ..... 123/90.16; 123/90.22; 123/198 F

[58] Field of Search ..... 123/90.15, 90.16, 123/90.17, 90.22, 90.39, 90.4, 198 F

[56] References Cited

U.S. PATENT DOCUMENTS 5,085,182 2/1992 Nakamura et al. ..... 123/90.16
5,099,806 3/1992 Murata et al. ..... 123/90.16
5,297,516 3/1994 Hara ..... 123/90.16
5,435,276 7/1995 Nakamura et al. ..... 123/90.16
5,445,116 8/1995 Hara ..... 123/90.16
5,544,626 8/1996 Diggs et al. ..... 123/90.16

*Primary Examiner*—Weilun Lo
*Attorney, Agent, or Firm*—Foley & Lardner

[57] ABSTRACT

A cylinder valve operating system comprises a pivotable rocker arm engaged with at least one cylinder valve, a first free cam follower supported by the rocker arm and driven by a first cam with a cam profile suitable for operation at low engine speeds, a second free cam follower supported by the rocker arm and driven by a second cam with a cam profile suitable for operation at high engine speeds, a first lever for establishing a positive motion connection between the first free cam follower and the rocker arm, a second lever for establishing a positive motion connection between the second free cam follower and the rocker arm, and a hydraulic driver for the first and second levers.

22 Claims, 5 Drawing Sheets

CYLINDER VALVE OPERATING SYSTEM

BACKGROUND OF THE INVENTION

1. Field of the Invention

The present invention relates to a cylinder valve operating system for internal combustion engines.

2. Description of the Prior Art

U.S. Pat. No. 5,099,806 issued to Murata et al on Mar. 31, 1992 discloses a cylinder valve operating system. The known valve system comprises a camshaft, a rocker shaft, a rocker arm fixedly mounted by spline connection to the rocker shaft, a free cam follower or a sub-rocker arm pivotally mounted to the rocker shaft, a cam mounted to the camshaft in driving engagement with the cam follower, engaging means for engaging and disengaging the rocker shaft with and from the free cam follower, and driving means for driving the engaging means. The free cam follower has a bore defining cylindrical inner surface in slidable contact with a cylindrical circumferential surface of the rocker shaft. The engaging means includes an aperture within the cylindrical inner surface of the free cam follower, and a coupling plunger received in a radial bore formed in the rocker shaft to define a hydraulic fluid pressure chamber in the radial bore or in the aperture. The driving means includes a solenoid operated valve for controlling supply of hydraulic fluid pressure to and discharge thereof from the hydraulic fluid pressure chamber. A compression spring is disposed in the radial bore to bias the coupling plunger away from or disengaged from the aperture when hydraulic fluid pressure when hydraulic fluid pressure in the hydraulic fluid pressure chamber is low. In an alternative embodiment, a compression spring disposed in the radial bore biases the coupling plunger toward or into the aperture when hydraulic fluid pressure in the hydraulic fluid pressure chamber is low. In this case, the hydraulic fluid pressure chamber is defined in the aperture. When the coupling plunger is inserted into the aperture, the rocker shaft is in driving engagement with the free cam follower for unitary motion therewith and thus the rocker arm operates to actuate a cylinder valve or valves in accordance with the profile of the cam on the camshaft. In this mode of operation, the coupling plunger bears all stress at a top portion thereof engaging the aperture defining edge and substantially great force is applied to the plunger at the top portion during lifting or opening of the cylinder valve against a valve return spring since the coupling plunger engages the aperture defining edge at a portion adjacent an axis about which the rocker arm rotates. When the coupling plunger is disengaged from the aperture, the rocker arm is rendered inoperable to leave the cylinder valve closed while the free cam follower moves in accordance with the profile of the cam on the camshaft.

According to this known structure, when it fails to insert the aperture, the coupling plunger is pressed back into the bore to abut the bore defining cylindrical inner surface until the aperture of the free cam follower comes into alignment with the bore in which the coupling plunger is disposed. Thus, the coupling plunger wears quickly at a corner where the top portion connects with a cylindrical circumferential surface of the coupling plunger since this corner is where the coupling plunger is engaged by the aperture defining edge during the above mentioned movement of the coupling plunger after the coupling plunger has failed to insert the aperture. Besides smooth movement of the free cam follower is interferenced owing to firm engagement of the top portion of the coupling plunger with the bore defining cylindrical inner surface of the free cam follower, causing unsmooth engagement with the cam on the camshaft accompanied by noise.

An object of the present invention is to provide a cylinder valve operating system which employs an abrasion free and noise free arrangement for bringing a rocker arm into unitary motion with a free cam follower.

SUMMARY OF THE INVENTION

According to the present invention, there is provided a cylinder valve operating system comprising:

at least one cylinder valve;

a camshaft with at least one set of cams including a first cam and a second cam;

a rocker arm pivotable about a rocker arm axis, said rocker arm having at least one finger engageable with said at least one cylinder valve for actuating said cylinder valve as said rocker arm pivots about said rocker arm axis, a first free cam follower supported by said rocker arm for pivotable motion about a first free cam follower axis stationary relative to said rocker arm and driven by said first cam for pivotable motion relative to said rocker arm about said first free cam follower axis;

a first lever supported by said rocker arm for rotatable motion about a first lever axis stationary relative to said rocker arm, said first lever having an engaged position wherein said first lever is in driving engagement with said first free cam follower at a portion radially spaced from said rocker arm axis to provide a positive motion connection between said first free cam follower and said rocker arm as said free cam follower pivots and a disengaged position wherein said first lever is out of driving engagement with said first free cam follower to provide a lost motion between said first free cam follower and said rocker arm as said first free cam follower pivots;

a second free cam follower supported by said rocker arm for pivotable motion about a second free cam follower axis and driven by said second cam for pivotable motion relative to said rocker arm about said second free cam follower axis;

a second lever supported by said rocker arm for rotatable motion about a second lever axis stationary relative to said rocker arm, said second lever having an engaged position wherein said second lever is in driving engagement with said second free cam follower at a portion radially spaced from said rocker arm axis to provide a positive motion connection between said second free cam follower and said rocker arm as said second free cam follower pivots and a disengaged position wherein said first lever is out of driving engagement with said second free cam follower to provide a lost motion between said second free cam follower and said rocker arm as said second free cam follower pivots;

a first spring resiliently biasing said first lever toward said engaged position thereof;

a second spring resiliently biasing said second lever toward said disengaged position thereof; and means for driving said first lever toward said disengaged position thereof against said first spring and said second lever toward said engaged position thereof against said second spring.

DETAILED DESCRIPTION OF THE INVENTION

Figure 1:
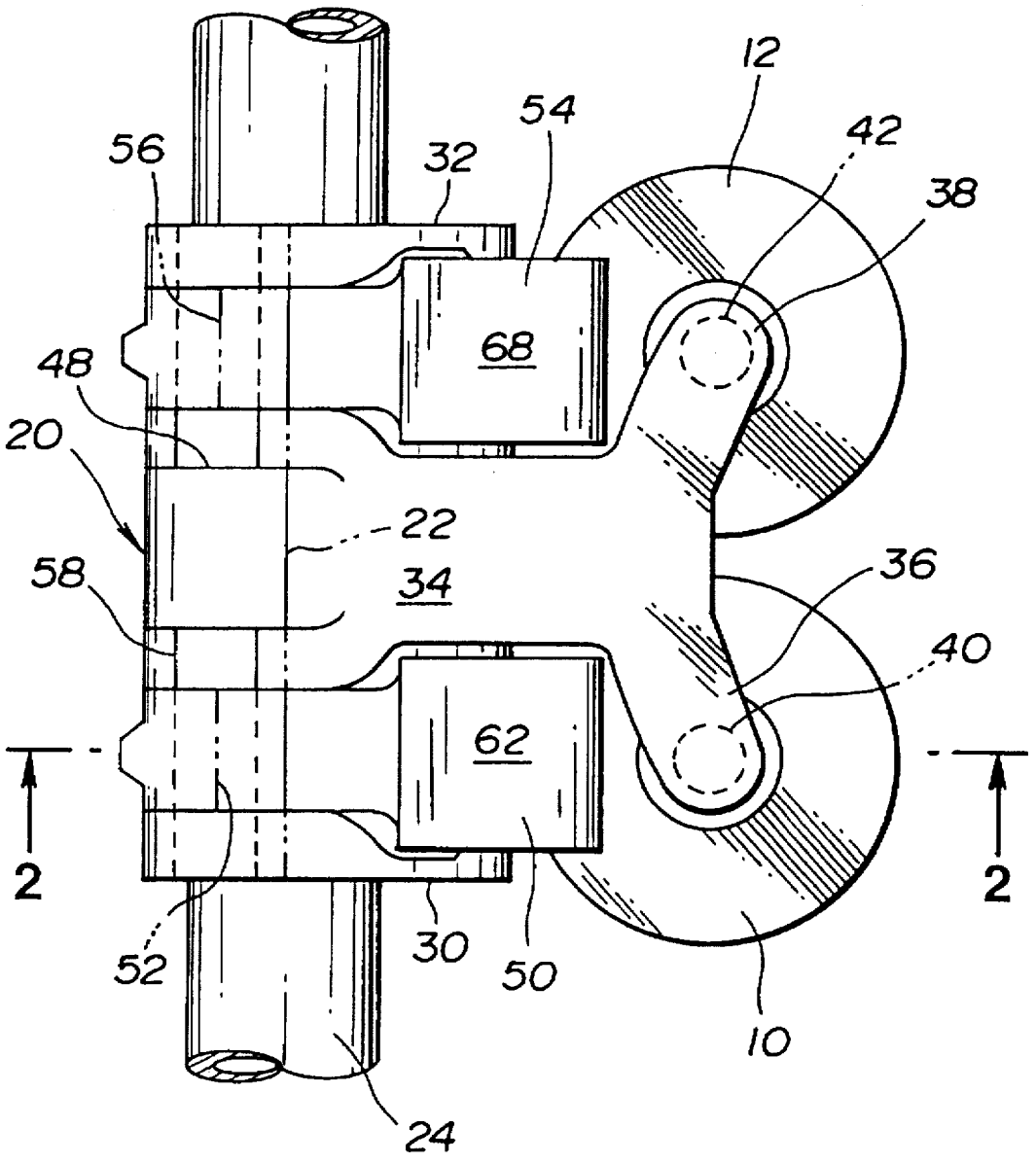
FIG. 1 is a fragmentary top plan view of a cylinder head of an internal combustion engine with a camshaft removed.

Referring to the accompanying drawings, a first embodiment of a cylinder valve operating system according to the present invention is described in connection with FIGS. 1 to 4, while a second embodiment is described in connection with FIG. 5. Like reference numerals and characters are used through the Figures to designate like or similar parts. In these embodiments, the invention is embodied in a cylinder valve operating system of the variable valve lift (VVL) type of an engine having, per each cylinder, two valves with the same function, e.g., two intake valves or two exhaust valves. The invention is not limited to this application. The invention is equally applicable to a cylinder valve operating system of the VVT of an engine having, per each cylinder, a single valve for performing an intake operation or an exhaust operation. As the discussion proceeds, it will be well appreciated that the invention is applicable to a cylinder valve operating system of the type wherein the valve timing and lift is unaltered.

In FIG. 1, there are shown two poppet type cylinder valves 10 and 12 which are arranged for each of cylinders of an internal combustion engine. A camshaft 14 is rotatably supported by a cylinder head of the engine in a known manner and has a plurality, corresponding in number to a plurality of cylinders of the engine sets of cams each set including a first cam 16 and a second cam 18 although only one set is shown in FIG. 3. The first cam 16 is a so-called low lift cam having a cam profile suitable for engine operation at low speeds, while the second cam 18 is a so-called high lift cam having a cam profile editable for engine operation at high speeds. The first and second cams 16 and 18 are spaced from each other along an axis of rotation o the camshaft 14 (see FIG. 3). In FIG. 3, the reference numeral 20 designates a rocker arm pivotable about a rocker arm axis as indicated by a phantom line 22. This rocker arm 20 is out of direct engagement with the cams 16 and 18. As readily seen from FIGS. 1 and 2, the rocker arm 20 is supported by a rocker arm shaft 24 which is rotatably supported by the engine cylinder head such that the rocker arm axis 22 aligns with an axis of rotation of the rocker arm shaft 24. Alternatively, a rocker arm shaft 24 may be non-rotatably mounted to the engine cylinder. In this case, a rocker arm 20 is rotatably supported by the rocker arm shaft 24.

The rocker arm 20 includes a hub 26 formed with a cylindrical bore 28 which receives the rocker arm shaft 24. Viewing In FIG. 3, the rocker arm 24 has a left wing 30, a right wing 32 and a central wing 34 between the left and right wings 30 and 32. The left, central and right wings 28, 34 and 32 are spaced one after another along the rocker arm axis 22 and integrally interconnected by the hub 26. The central wing 34 extends toward the cylinder valves 10 and 12 and has and terminates at two fingers, namely a first finger 36 and a second finger 38, for abutting engagement with valve stems 40 and 42 of the cylinder valves 10 and 12, respectively. The cylinder valves 10 and 12 are biased to closed positions thereof by means of valve springs, only one being shown at 44 in FIG. 2 acting at one end on a valve retainer 46 fixed to the valve stem 40 and acting at the other end on the engine cylinder head.

As shown in FIGS. 1 end 2, the central wing 34 includes an elevation 48 projecting from the hub 26 away from the rocker arm axis 22.

Disposed between the left wing 30 and the elevation 48 of the central wing 34 is a first free cam follower 50. The first free cam follower 50 Is supported by the rocker arm 20 for pivotal motion about a first free cam follower axis, indicated by the phantom line 52, stationary relative to the rocker arm 20 and arranged for engagement with the first cam 16 to be driven thereby for pivotal motion toward the hub 26 relative to the rocker arm 20 about the first free cam follower axis 52.

Disposed between the elevation 48 of the central wing 34 and the right wing 32 is a second free cam follower 54. The second free cam follower 54 is supported by the rocker arm 20 for pivotal motion about a second free cam follower axis, indicated by the phantom line 56, stationary relative to the rocker arm 20 and arranged for engagement with the second cam 18 to be driven thereby for pivotal motion toward the hub 26 relative to the rocker arm 20 about the second free cam follower axis 56.

The first and second free cam followers 50 and 54 are rotatably supported by a bearing shaft 58 extending from the left wing 30 to the right wing 32 passing through the elevation 48 of the central wing 34 such that the first and second free cam follower axes 52 and 56 are aligned with a longitudinal center line of the bearing shaft 58. As is seen from FIGS. 1 and 2, the first and second free cam follower axes 52 and 56, which are aligned with each other in this embodiment, are offset from the rocker arm axis 22.

Figure 2:
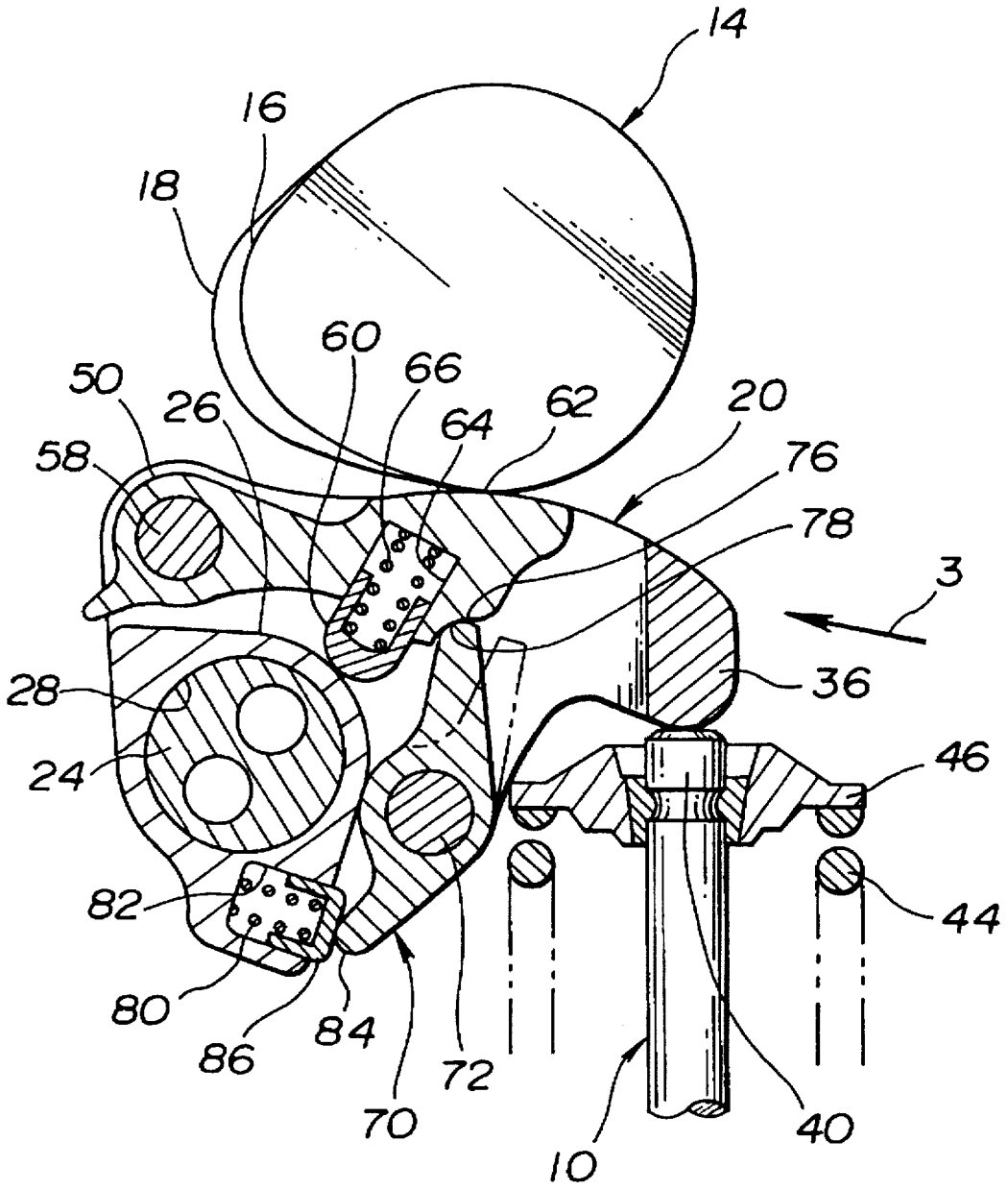
FIG. 2 is a side view a rocker arm including a section taken through the line 2—2 of FIG. 1
Figure 3:
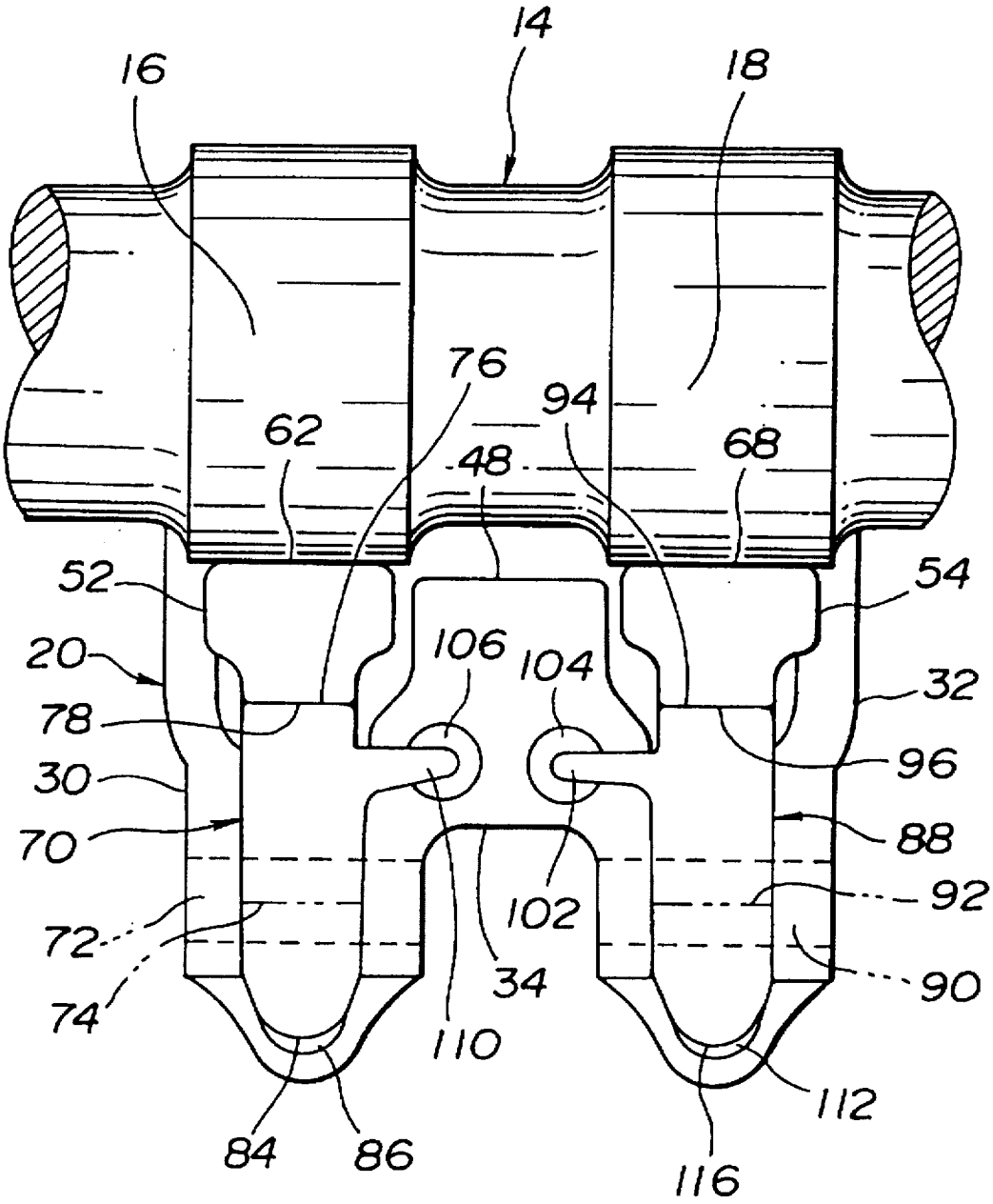
FIG. 3 is a front plan view viewing FIG. 2 in a direction as indicated by an arrow 3 with finger portions of a rocker arm and cylinder valves removed to show arrangement of levers cooperating with free cam follower.

Referring to FIG. 2, the first free cam follower 50 includes a prop 60 supporting the first free cam follower 50 on the hub 26 to keep appropriate engagement relation of a rounded bearing surface 62 thereof with the first cam 16. The prop 60 is retractable to provide a lost motion connection between the first free cam follower 50 and the hub 26 of the rocker arm 20. Specifically, the prop 60 is slidably received in a bore 64 of the first free cam follower 50. A lost motion compression spring 66 is disposed in the bore 66 with one end thereof bearing against the bore end and opposite end thereof bearing against the prop 60, biasing the prop 60 against the hub 26 of the rocker arm 20. Prefer.ably, the first free cam follower axis 52 is arranged relative no the rocker arm axis 22 such that, when the first free cam follower 50 is driven by the first cam 16 to pivot toward the hub 26 about the first free cam follower axis 52, a force applied to the hub 26 due to compression of the lost motion spring 66 does not produce any substantial moment about the cooker arm axis 22.

Similarly, the second free cam follower 54 includes a prop supporting the second free cam follower 54 on the hub 26 to keep appropriate engagement relation of a rounded bearing surface 68 (see FIGS. 1 and 3) thereof with the second cam 16. The prop has the same functionality as that of the prop 60 and is retractable to provide a lost motion connection between the second free cam follower 54 and the hub 26 of the rocker arm 20.

A first lever 70 is supported by the rocker arm 20 between the lest wing 30 and the central wing 34 for transmitting the pivotal motion of the first free cam follower 50 to the rocker arm 20, thereby to urge the rocker arm 20 to pivot against the action of the valve springs of the first and second cylinder valves 10 and 12. The first lever 70 is rotatably supported by a bearing shaft 72 having one end connected to the left wing 30 and the opposite end connected to the central wing 34. The first lever 70 is pivotable about a first lever axis 74 that is aligned with a longitudinal center line of the bearing shaft 72. The first lever axis 74 is spaced in parallel relation from the rocker arm axis 22 and angularly displaced from the first free cam follower axis 52 with respect to the rocker arm axis 22.

The first lever 70 has an engaged position as illustrated by the fully drawn line in FIG. 2 wherein the first lever 70 is in driving engagement with the first free cam follower 50 at a portion radially spaced from the rocker arm axis 22. In this engaged position, the first lever 70 engages at a top end 76 thereof a donwardly facing ceiling 78 with which the first free cam follower 50 is formed. Owing to this engagement, the pivot motion of the first free cam follower 50 is transmitted to the bearing shaft 72 which in turn transmits the motion to the rocker arm 20, thus providing a positive motion connection between the first free cam follower 50 and the rocker arm 20 as the first free cam follower 50 pivots toward the rocker arm axis 22. The first lever 70 has a disengaged position as illustrated by the phantom line in FIG. 2 wherein the first lever 70 is out of driving engagement with the first free cam follower 50. In this disengaged position, the first lever 70 is disposed out of the path of pivotal motion of the first free cam follower 50, thereby to provide or allow lost motion connection between the first free cam follower 50 and the rocker arm 20 as the first free cam follower 50 pivots toward the rocker arm axis 22.

A first compression spring 80 is disposed in a bore 82 recessed into the hub 26 of the rocker arm 20 at a location adjacent a bottom end 84 of the first lever 70. A spring retainer 86 is slidably received in the bore 82. The first spring 80 has one end acting on the bore end and the opposite end acting on the spring retainer 86, keeping the spring retainer 86 in engagement with a portion of the first lever 70 adjacent the bottom end 84 thereof. Owing to the action of the first spring 80, the first lever 70 is resiliently biased toward the engaged position thereof.

A second lever 88 18 supported by the rocker arm 20 between the central wing 34 and the right wing 32 for transmitting the pivotal motion of the second free cam follower 54 to the rocker arm 20, thereby to urge the rocker arm 20 to pivot against the action of the valve springs of the first and second cylinder valves 10 and 12. The second lever 70 is rotatably supported by a bearing shaft 90 having one end connected to the central wing 34 and the opposite end connected to the right wing 32. The second lever 88 is pivotable about a second lever axis 92 that is aligned with a longitudinal center line of the bearing shaft 90. The second lever axis 92 is spaced in parallel relation from the rocker arm axis 22 and angularly displaced from the second free cam follower axis 56 with respect to the rocker arm axis 22.

The second lever 88 has an engaged position similarly to the engaged position as illustrated by the fully drawn line in FIG. 2 wherein the second lever 88 is in driving engagement with the second free cam follower 54 at a portion radially spaced from the rocker arm axis 22. In this engaged position, the second lever 88 engages at a top end 94 thereof a downwardly facing ceiling 96 with which the second free cam follower 54 is formed. Owing to his engagement, the pivot motion of the second free cam follower 54 is transmitted to the bearing shaft 90 which in turn transmits the motion to the rocker arm 20, thus providing a positive motion connection between the second free cam follower 54 and the rocker arm 20 as the second free cam follower 54 pivots toward the rocker arm axis 22. The second lever 70 has a disengaged position similarly to the disengaged position as illustrated by the phantom line in FIG. 2 wherein the second lever 88 is out of driving engagement with the second free cam follower 54. In this disengaged position, the second lever 88 is disposed out of the path of pivotal motion of the second free cam follower 54, thereby to provide or allow lost motion connection between the second free cam follower 54 and the rocker arm 20 as the second free cam follower 54 pivots toward the rocker arm axis 22.

Figure 4:
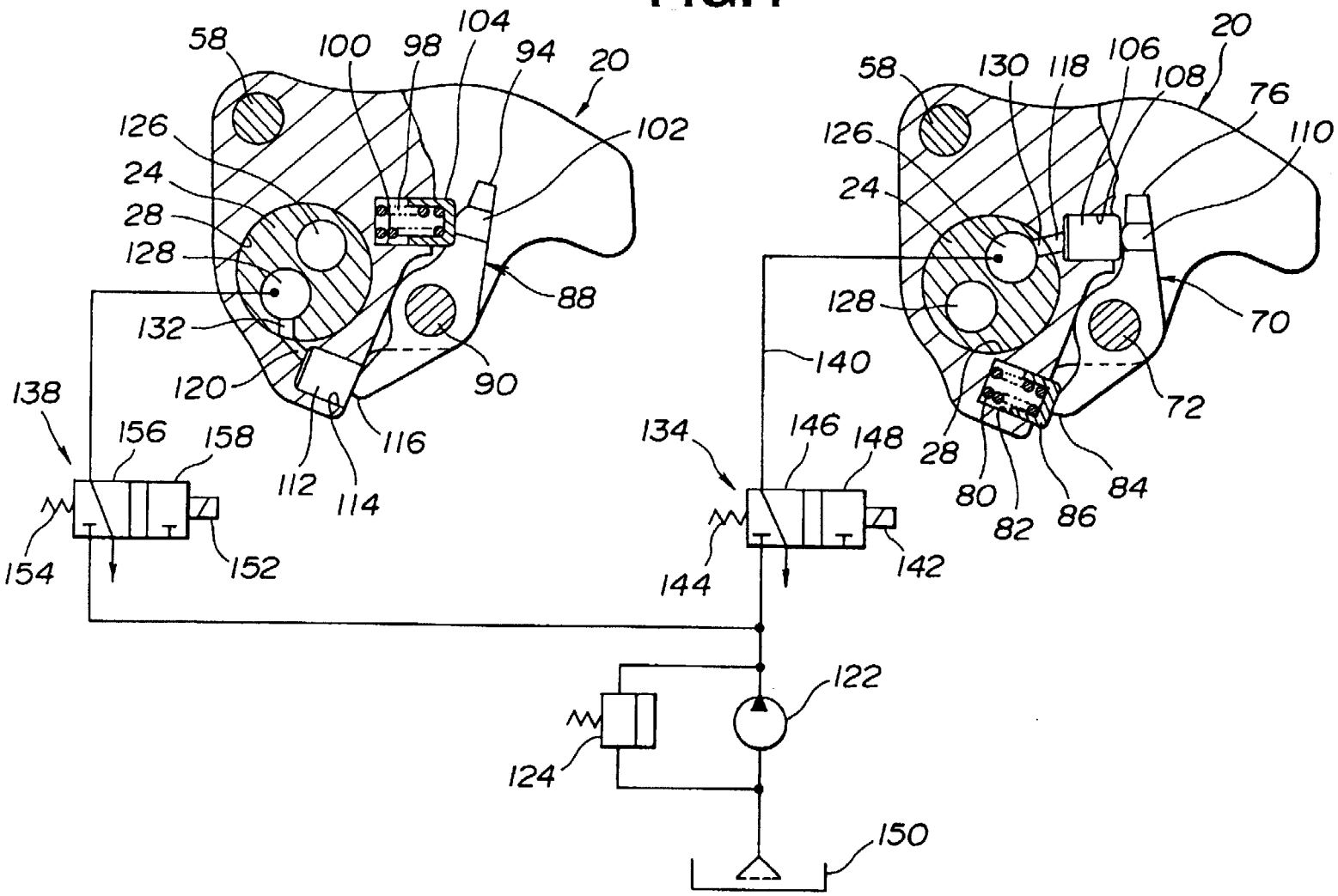
FIG. 4 is a schematic diagram of a driver for driving the levers.

As seen in FIG. 4, a second compression spring 98 is disposed in a bore 100 recessed into the hub 26 of the rocker arm 20 at a location adjacent an integral ear 102 which extends laterally from a portion adjacent the top end 94 of the second lever 88 toward the first lever 70. A Spring retainer 104 is slidably received in the bore 100. The second spring 98 has one end acting on the bore end and the opposite end acting on the spring retainer 104, keeping the spring retainer 104 in engagement with the ear 102 of the second lever 70. Owing to the action of the second spring 98, the second lever 70 is resiliently biased toward the disengaged position thereof.

FIG. 4 illustrates a preferred implementation of a driver of a cylinder valve operating system according to the present invention. The driver is adapted to drive the first lever 70 toward the disengaged position thereof against the first spring 80 and the second lever 88 toward the engaged position thereof against the second spring 98, a first hydraulic piston 106 is slidably disposed in a bore 188 recessed into the hub 26 at a location adjacent an integral ear 110 (see FIG. 3) which extends laterally from a portion adjacent the top end 76 of the first lever 76 toward the second lever 88, and a second hydraulic piston 112 is slidably disposed in a bore 114 recessed into the hub 26 at a location adjacent a bottom end 116 of the second lever 88 (see FIG. 3).

Although not illustrated in detailed in FIG. 4, the first hydraulic piston 106 defines in the bore 108 a hydraulic fluid pressure chamber to which a hydraulic fluid passage 118 is open at one end thereof. At the other end thereof, this hydraulic fluid passage 118 is open to the cylindrical bore 28 in which the rocker arm shaft 24 is disposed. The first hydraulic piston 106 engages the ear 110 of the first lever 70 such that, when hydraulic fluid pressure is zero or very low in the hydraulic fluid pressure chamber to which the first hydraulic piston 106 is exposed, the first lever 70 which is subjected to torque owing to the spring 80 biases the first hydraulic piston 106 into the bore 108 to a recessed position thereof. As the hydraulic fluid pressure in the hydraulic fluid pressure chamber increases, the first hydraulic piston 106 is pushed against the ear 110, urging the first lever 70 to turn clock wise, viewing in FIG. 4, against the first spring 80 toward the engaged position thereof.

The second hydraulic piston 112 defines in the bore 114 a hydraulic fluid pressure chamber to which a hydraulic fluid passage 120 is open at one end thereof. At the other end thereof, this hydraulic fluid passage 120 is open to the cylindrical bore 28 in which the rocker arm shaft 24 extends. The second hydraulic piston 112 engages the portion adjacent the bottom end 116 of the second lever 88 such that, when hydraulic fluid pressure is zero or very low in the hydraulic fluid pressure chamber to which the second hydraulic piston 112 is exposed, the second lever 70 which is subjected to torque owing to the spring 98 biases the second hydraulic piston 112 into the bore 114 to a recessed position thereof. As the hydraulic fluid pressure in the hydraulic fluid pressure chamber increases, the second hydraulic piston 112 As pushed against the portion adjacent the bottom end of 116 of the second lever 88, urging the second lever 70 to turn clockwise, viewing in FIG. 4, against the second spring 98 toward the engaged position thereof.

The driver includes a first hydraulic circuit fluidly disposed between the bore 108 of the first piston 108 and a source of hydraulic fluid pressure including a pump 122 driven by the engine and a pressure regulator 124, and a second hydraulic circuit fluidly disposed between the bore 114 and the source of hydraulic fluid pressure.

The first hydraulic fluid circuit includes the hydraulic fluid passage 118 opening 0 the cylindrical bore 28 and a first axial passage 126 with which the rocker arm shaft is formed while the second hydraulic fluid circuit includes the hydraulic fluid passage 120 opening to the cylindrical bore 28 and a second axial passage 128 with which the rocker arm shaft 24 is formed. The first and second axial passages 126 and 128 are independent from each other in the rocker arm shaft 24, The rocker arm shaft 24 is formed with a radial port 130 opening to the first axial passage 126 and with a second radial port 132 opening to the second axial passsage 128. The first radial port 130 is so dimensioned and arranged as to establish constant fluid communication between the first axial passage 126 and the hydraulic fluid passage 118, while the second radial port 132 is so dimensioned and arranged as to establish constant fluid communication between the second axial passage 128 and the hydraulic fluid passage 120. The first axial passage 126 is fluidly connected to an output port of a first solenoid operable valve 134 via a hydraulic fluid line diagrammatically illustrated at 136, while the second axial passage 128 is fluidly connected to a second solenoid operable valve 138 via a hydraulic fluid line diagrammatically illustrated at 140.

The first solenoid operable valve 134 has a solenoid 142 and a spring 144. When the solenoid 142 is not energized, the first solenoid operable valve 134 assumes a spring set fluid discharge position 146, while, when the solenoid 142 is energized, the first solenoid operable valve 134 assumes fluid supply position 148. In the discharge position 146, the hydraulic fluid line 136 is connected to a drainage 150, allowing discharge of hydraulic fluid from the bore 108, causing the first hydraulic piston 106 to assume the recessed position thereof. In the supply position 148, the hydraulic fluid line 136 is connected to the pump 122, allowing supply of hydraulic fluid to the bore 108, urging the first hydraulic piston 106 to move the first lever 70 against the first spring 80.

The second solenoid operable valve 138 has a solenoid 152 and a spring 154. When the solenoid 154 is not energized, the second solenoid operable valve 138 assumes a spring set fluid discharge position 156, while, when the solenoid t52 is energized, the second solenoid operable valve 138 assumes a fluid supply position 158. In the discharge position 156, the hydraulic fluid line 140 is connected to the drainage 150, allowing discharge of hydraulic fluid from the bore 114, causing the second hydraulic piston 112 to assume the recessed position thereof. In the supply position 158, the hydraulic fluid line 140 is connected to the pump 122, allowing supply of hydraulic fluid to the bore 114, urging the second hydraulic piston 112 to move the second lever 88 against the second spring 98.

Let us now assume that the engine is not in operation and the pump 24 does not discharge any hydraulic fluid. Under this condition, no current s supplied to the solenoids 142 and 152 of the first an second solenoid operable valves 134 and 138 and there is no supply of hydraulic fluid to the first and second axial passages 126 and 128 because both the first and second solnoids operable valves 134 and 138 assume the discharge positions 146 and lB6, respectively. Thus, the first lever 70 engages the first free cam follower 50 so that the first free cam follower 50 and the rocker arm 20 are engaged to be driven by the first cam 16, while the second lever 88 disengages from the second free cam follower 54. Since, without any supply of hydraulic fluid, the rocker arm 20 is driven by the first cam 16 with the low lift cam profile during cranking, the engine cranking speed increases quickly to provide good start-up performance of the engine.

Split cylinder mode engine operation is desired during drive in urban area when the engine operates at low speeds with low load to reduce pumping loss. To shift from full cylinder mode to split cylinder mode, one or some of the engine cylinders are inactivated by leaving the associated intake valves closed by energizing the solenoid 142 of the first solenoid operable valve 134 with the solenoid 152 of the second solenoid operable valve 138 denergized. This causes the first solenoid operable valve 134 to shift to the supply position 148 thereof, supplying hydraulic fluid to the first axial passage 26, urging the first hydraulic piston 106 to move the first lever 70 against the first spring 80 into disengagement from the first free cam follower 50. Both the first and second free cam followers 50 and 54 are disengaged from the rocker arm 20 when the first solenoid operable valve 134 assumes the supply position 148 thereof and the second solenoid operable valve 138 assumes the discharge position 156 thereof.

During engine operation at high speeds, both the first and second solenoids 142 and 152 are energized to cause the first and second solenoid operable valves 134 and 138 to assume the supply positions 148 and 158, respectively. Under this condition, the first lever 70 is disengaged from the first free cam follower 50 and the second lever 88 engages the second free cam follower 54 so that the second free cam follower 54 and the rocker arm 20 are engaged to be driven by the second cam 18 having high lift cam profile.

Figure 5:
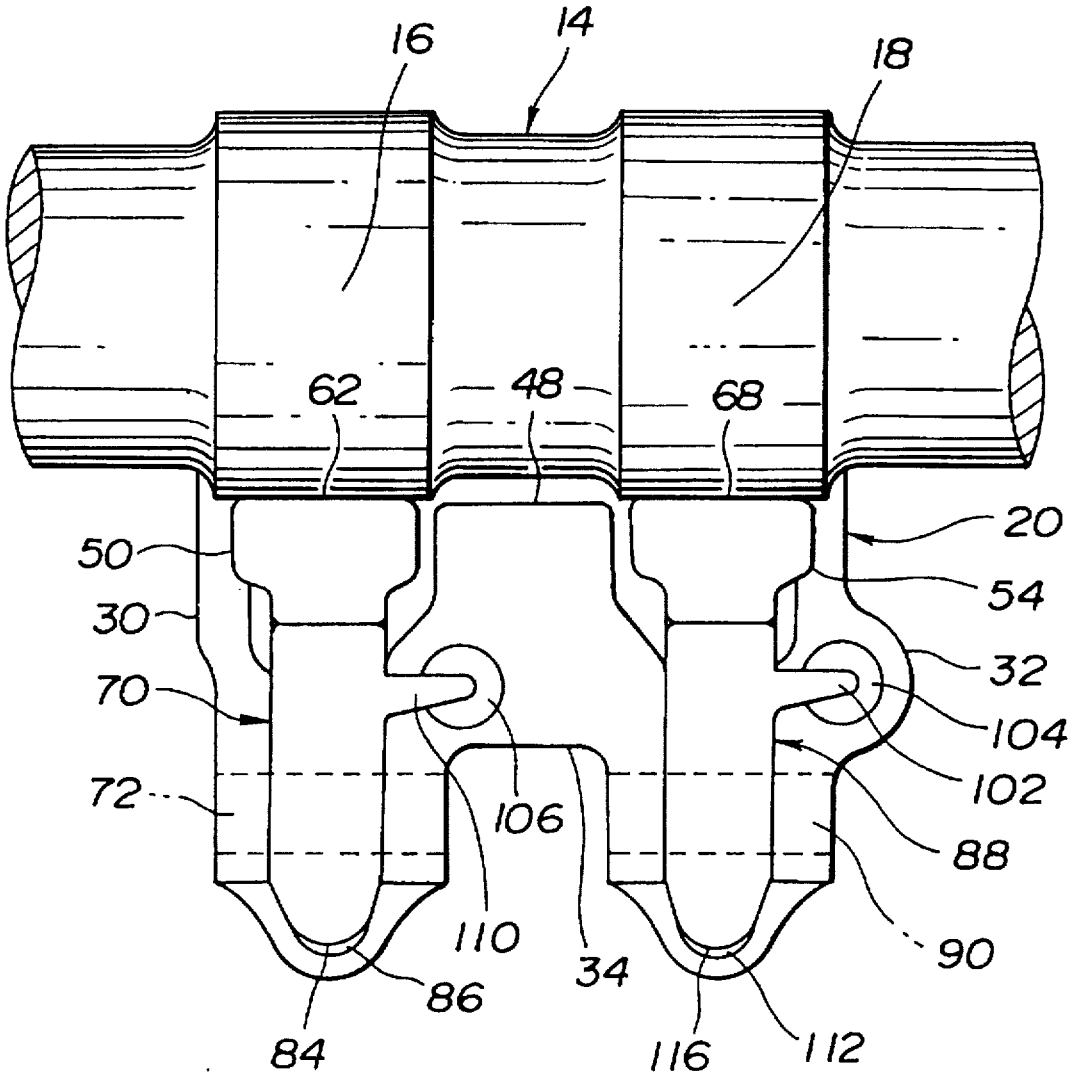
FIG. 5 is a similar view to FIG. 3 illustrating a second embodiment according to the present invention.

FIG. 5 illustrates the second embodiment. This second embodiment is substantially the same as the first embodiment. The second embodiment is different from the first embodiment in that a second lever 88 has an ear 102 extending in the same direction as an ear 110 of a first lever 70 does, and a second spring 98 and a bore 100 for the second spring 98 are arranged adjacent a right wing 32 of a rocker arm 20. This embodiment is advantageous in that both first and second levers 70 and 88 are identical in construction. This results in reduction in number of parts to be assembled.

From the preceding description, it is appreciated that the top ends 78 and 94 of the first and second levers 70 and 88 cooperate with the downwardly facing ceilings 78 and 96 of the first and second free cam followers 50 and 54, respectively, upon establishing positive motion connection between the first or second free cam follower 50 or 54 and the rocker arm 20. This arrangement is advantageous in reducing pressure per unit area upon establishing the positive motion connection. This is because sufficiently large area is provided for engagement of the first or second lever 70 or 88 with the corresponding one of the firs and second free cam followers 50 and 54 and such engagement As conducted at a portion radially spaced from the rocker arm axis 22. This results in suppressing failure upon engagement of the first and second free cam followers 50 and 54 with the rocker arm 20.

It will also be appreciated that the first and second hydraulic pistons 106 and 112 are not subjected to any stress tending to incline the piston with respect to the bore. Thus smooth stress free movement of the hydraulic piston is assured and the bore wall and the piston cylindrical wall are free from abrasion. Thus, there occurs no leak of hydraulic fluid through clearance be ween the piston and the bore wall, resulting in improved resposiveness of the piston movement to change between the discharge position and the supply position of the solenoid operable valve. Since here occurs no stress tending to incline the rocker arm 20 with respect to the rocker arm shaft 24 upon being engaged by the firs or second free cam follower 50 or 54 via the first or second lever 70 or 88, the accuracy with which the firs and second free cam followers 50, 54 and the rocker arm 20 are interconnected is maintained over an elongated period of use.

What is claimed is:

1. A cylinder valve operating system comprising:

at least one cylinder valve;

a camshaft with at least one set of cams including a first cam and a second cam;

a rocker arm pivotable about a rocker arm axis, said rocker arm having at least one finger engageable with said at least one cylinder valve for actuating said cylinder valve as said rocker arm pivots about said rocker arm axis;

a first free cam follower supported by said rocker arm for pivotable motion about a first free cam follower axis stationary relative to said rocker arm and driven by said first cam for pivotable motion relative to said rocker arm about said first free cam follower axis;

a first lever supported by said rocker arm for rotatable motion about a first lever axis stationary relative to said rocker arm, said first lever having an engaged position wherein said first lever is in driving engagement with said first free cam follower at a portion radially spaced from said rocker arm axis to provide a positive motion connection between said first free cam follower and said rocker arm as said free cam follower pivots, and a disengaged position wherein said first lever is out of driving engagement with said first free cam follower to provide a lost motion between said first free cam follower and said rocker arm as said first free cam follower pivots;

a second free cam follower supported by said rocker arm for pivotable motion about a second free cam follower axis and driven by said second cam for pivotable motion relative to said rocker arm about said second free cam follower axis;

a second lever supported by said rocker arm for rotatable motion about a second lever axis stationary relative to said rocker arm, said second lever having an engaged position wherein said second lever is in driving engagement with said second free cam follower at a portion radially spaced from said rocker arm axis to provide a positive motion connection between said second free cam follower and said rocker arm as said second free cam follower pivots, and a disengaged position wherein said second lever is out of driving engagement with said second free cam follower to provide a lost motion between said second free cam follower and said rocker arm a said second free cam follower pivots;

a first spring resiliently biasing said first lever toward said engaged position thereof;

a second spring resiliently biasing said second lever toward said disengaged position thereof; and means for driving saint first lever toward said disengaged position thereof against said first spring and said second lever toward said engaged position thereof against said second spring.

2. A cylinder valve operating system as claimed in claim 1, wherein said rocker arm includes a hub formed with a cylindrical bore which receives a rocker arm shaft supporting said rocker arm for pivotable motion about said rocker arm axis;

wherein said rocker arm includes a first wing, a second wing and a third central wing between said first and second wings, said first, third central and second wings being spaced one after another along said rocker arm axis and integrally interconnected by said hub;

wherein said third central wing extends toward said cylinder valve and terminates at a finger for abutting engagement with said at least one cylinder valve;

wherein said rocker arm includes a bearing shaft extending between said first and second wings passing through said third central wing;

wherein said first free cam follower is disposed between said first wing and third central wing and supported by said bearing shaft, and said second free cam follower is disposed between said third central wing and said second wing and supported by said bearing shaft; and wherein said first lever is rotatably supported by and disposed between the first wing and said third central wing, and said second lever is rotatably supported by and between said third central wing and said second wing.

3. A cylinder valve operating system as claimed in claim 1, wherein said driving means is in the form of hydraulic means.

4. A cylinder valve operating system as claimed in claim 1, wherein said second cam has a cam profile suitable for operation at high engine speeds.

5. A cylinder valve operating system as claimed in claim 3, wherein said second cam has a cam profile suitable for operation at high engine speeds.

6. A cylinder valve operating system as claimed in claim 5, wherein said first cam has a cam profile suitable for operation at low engine speeds.

7. A cylinder valve operating system as claimed in claim 1, wherein said first lever a axis and said second lever axis are aligned with each other.

8. A cylinder valve operating system as claimed in claim 3, wherein said first lever axis and said second lever axis are aligned with each other.

9. A cylinder valve operating system as claimed in claim 4, wherein said first lever axis and said second lever axis are al aligned with each other.

10. A cylinder valve operating system as claimed in claim 7, wherein said first and second levers are identical in construction.

11. A cylinder valve operating system as claimed in claim 8, wherein said first and second levers are identical in construction.

12. A cylinder valve operating system am claimed in claim 9, wherein said first and second levers are identical in construction.

13. A cylinder valve operating system as claimed in claim 3, wherein said hydraulic means include a first hydraulic piston slidably received in a first bore of said rocker arm adjacent said first lever, a second hydraulic piston slidably received in a second bore of said rocker a cm adjacent said second lever, a source of hydraulic fluid pressure, a first hydraulic fluid circuit fluidly disposed between said source of hydraulic fluid pressure and said first bore, and a second hydraulic fluid circuit fluidly disposed between said source of hydraulic fluid pressure and said second bore.

14. A cylinder valve operating system as claimed in claim 13, wherein said first hydraulic circuit includes a first solenoid operable valve having a discharge position wherein hydraulic fluid is discharged from said first bore and a supply position wherein hydraulic fluid is supplied from said source of hydraulic fluid pressure to said first bore.

15. A cylinder valve operating system as claimed in claim 14, wherein said second hydraulic circuit includes a second solenoid operable valve having a discharge position wherein hydraulic fluid is discharged from said second bore and a supply position wherein hydraulic fluid is supplied from said source of hydraulic fluid pressure to said second bore.

16. A cylinder valve operating system as claimed in claim 15, wherein said first cam has a cam profile suitable for operation at low engine speeds, and said second cam has a cam profile suitable for operation a high engine speeds.

17. A cylinder valve operating system as claimed in claim 15, wherein, when said first solenoid operable valve assumes said discharge position thereof and said second solenoid operable valve assumes said discharge position thereof, said first free cam follower and said rocker arm are engaged to be driven by said first cam.

18. a cylinder valve operating system as claimed in claim 17, wherein, when said first solenoid operable valve assumes said supply position thereof and said second solenoid operable valve assumes said supply position thereof, said second free cam follower and said rocker arm are engaged to be driven by said second cam.

19. A cylinder valve operating system as claimed in claim 18, wherein, when said first solenoid operable valve assumes said supply position thereof and said second solenoid operable valve assumes said discharge position thereof, both said first and second free cam followers are disengaged from said rocker arm, leaving said rocker arm at rest.

20. A cylinder valve operating system as claimed in claim 19, including a rocker arm shaft supporting said rocker arm.

21. A cylinder valve operating system as claimed in claim 20, wherein said rocker arm shaft is formed with a first axial passage and a second axial passage forming parts of said first and second hydraulic fluid circuits, respectively.

22. A cylinder valve operating system comprising:

at least one cylinder valve;

a camshaft with a cam;

a rocker arm pivotable about a rocker arm axis, said rocker arm having at least one finger engageable with said at least one cylinder valve for actuating said cylinder valve as said rocker arm pivots about said rocker arm axis;

a free cam follower supported by said rocker arm for pivotable motion about a free cam follower axis stationary relative to said rocker arm and driven by said cam for pivotable motion relative to said rocker arm about said free cam follower axis;

a lever supported by said rocker arm for rotatable motion about a first lever axis fixed to said rocker arm, said lever having an engaged position wherein said lever is in driving engagement with said free cam follower at a portion radially spaced from said rocker arm axis to provide a positive motion connection between said free cam follower and said rocker arm as said free follower pivots and a disengaged position wherein said lever is out of driving engagement with said free cam follower to provide a lost motion between said free cam follower and said rocker arm as said free cam follower pivots;

a spring resiliently biasing said lever toward said engaged position thereof; and means for driving said lever toward said disengaged position thereof against said spring.

* * * * *